United States Patent [19]

Schneider

[11] 3,946,648

[45] Mar. 30, 1976

[54] ROOF VENTILATOR

[75] Inventor: Heinrich Schneider, Sorga, Germany

[73] Assignee: Buttner-Schilde-Haas Aktiengesellschaft, Germany

[22] Filed: Feb. 28, 1973

[21] Appl. No.: 336,833

[30] Foreign Application Priority Data

Feb. 28, 1972 Germany ..... 2209301

[52] U.S. Cl. ..... 98/43 C; 415/DIG. 3

[51] Int. Cl.[2] ..... F24F 7/06

[58] Field of Search ..... 98/43; 417/352; 415/206, 415/219 C, 204, DIG. 3

[56] References Cited

UNITED STATES PATENTS

| | | | |
|---|---|---|---|
| 1,029,979 | 6/1912 | Ehrhart | 415/DIG. 3 |
| 2,805,615 | 9/1957 | Rudy | 98/43 |
| 2,832,292 | 4/1958 | Edwards | 415/DIG. 3 |
| 2,912,916 | 11/1959 | Mohrman | 98/43 |
| 3,110,357 | 11/1963 | Jenn et al. | 98/43 X |
| 3,202,081 | 8/1965 | Cook | 98/43 |
| 3,316,848 | 5/1967 | Egger | 415/DIG. 3 |
| 3,499,378 | 3/1970 | Baumann et al. | 417/353 X |

*Primary Examiner*—William E. Wayner
*Attorney, Agent, or Firm*—Hill, Gross, Simpson, Van Santen, Steadman, Chiara & Simpson

[57] ABSTRACT

A roof ventilator for radial or axial exhaust, comprising a ventilator housing supported on a base plate and enclosing an impeller wheel driven by a motor of the internal-rotor type or the external-rotor type, said ventilator housing comprising bottom and hood components of mutually similar bowl-shape, and said components for different capacity ventilators and different mounting of the motors being interchangeable to selectively accommodate radial and axial exhaust installations.

4 Claims, 5 Drawing Figures

ROOF VENTILATOR

Figure 1:
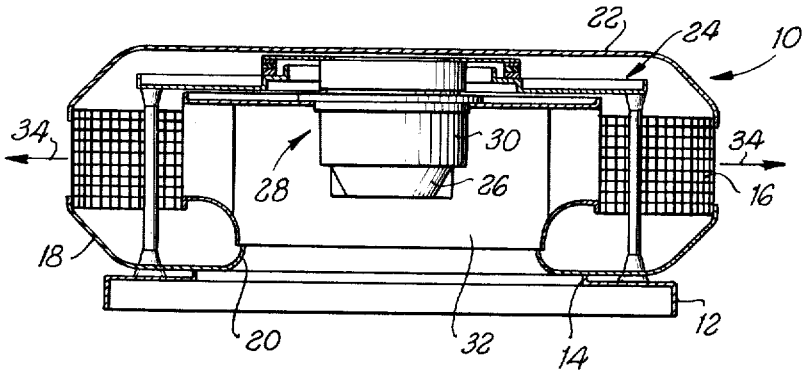

This invention relates to a roof ventilator with horizontal or vertical exhaust and with an impeller wheel which is driven by a motor of the internal-rotor or external-rotor type disposed within or on top of a housing secured to a base plate.

In prior art roof ventilators the widely varying requirements with regard to exhaust direction and types of impeller wheel and drive motor have resulted in ventilator designs which are expensive to manufacture and very different in exterior appearance and size for substantially equal capacity.

An object of the present invention is to largely eliminate the abovementioned disadvantages and shortcomings of the prior art roof ventilator constructions and to provide improved roof ventilators which may be manufactured at low cost in different standard size series, and which have optimum aerodynamic characteristics and the least possible structural height.

Another object of the inventon is to provide a roof ventilator of the kind indicated in which said housing for the motor comprises a cylindrical middle component, a bottom component and a hood component with said bottom and hood components of mutually similar bowl-like shape and of substantially equal diameter for each ventilator size, whereby in an axial exhaust ventilator the hood component of the motor housing may consist of a hood component of a smaller size radial exhaust ventilator.

Still another object of the invention is to provide a roof ventilator of the kind indicated in which one of said bottom components may be used as a hood component when its central suction opening is covered by a suitable means.

Accordingly, housing components of a horizontal exhaust roof ventilator are usable as housing components of a larger diameter vertical exhaust roof ventilator. This means not only a substantially simplified and thus cost-saving manufacture, but also a considerable uniformity in external shape, in spite of differences in the direction of exhaust, in the design of the impeller wheel, and in the drive motor and its mounting.

If in the case of vertical exhaust the motor is mounted above the impeller wheel, the hood component which is the hood component of a diametrically smaller roof ventilator for horizontal exhaust, constitutes the upper closure for an air impermeable cylinder which surrounds the motor and in turn forms the central component of the housing in a roof ventilator of less diameter with vertical exhaust.

Because of the bowl-shape of bottom and hood components it is feasible in a horizontal exhaust roof ventilator for the height of the air permeable central component to be essentially equal to the height of the (radial) impeller wheel at its circumference.

In a vertical exhaust roof ventilator according to the invention the central cylindrical component may in a further development of the invention be provided with an upper closure ring obtained by trimming away a radially inner portion of a bottom component or a hood component.

A further object of the invention is to provide in a roof ventilator of the kind indicated an impeller wheel of axial design propelled by a motor of the internal-rotor type means for retaining the motor within a trumpet-shaped hollow body which is at the same time an air guiding member. Said trumpet-shaped hollow body may consist of the hub disk of the radial impeller wheel of a similar roof ventilator of smaller diameter, that is to say, also in this respect similar structural components may be used which differ only in size.

Figure 2:
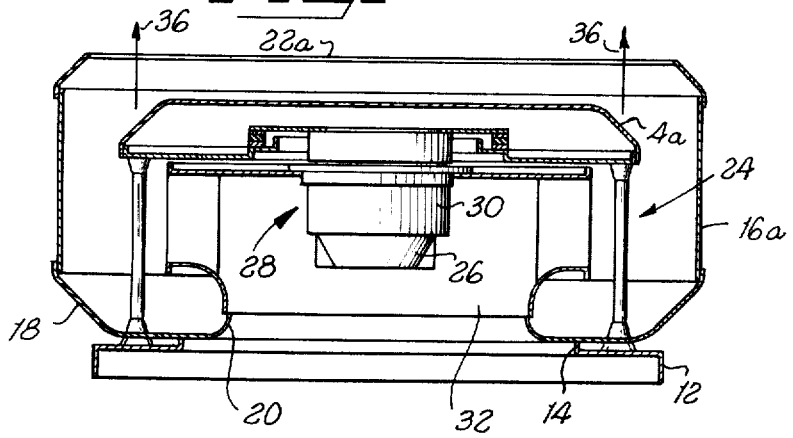
Figure 3:
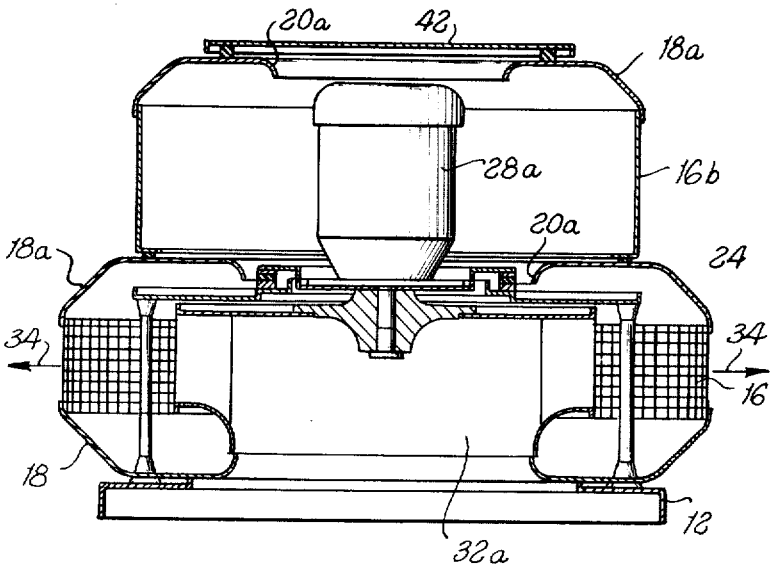
Figure 4:
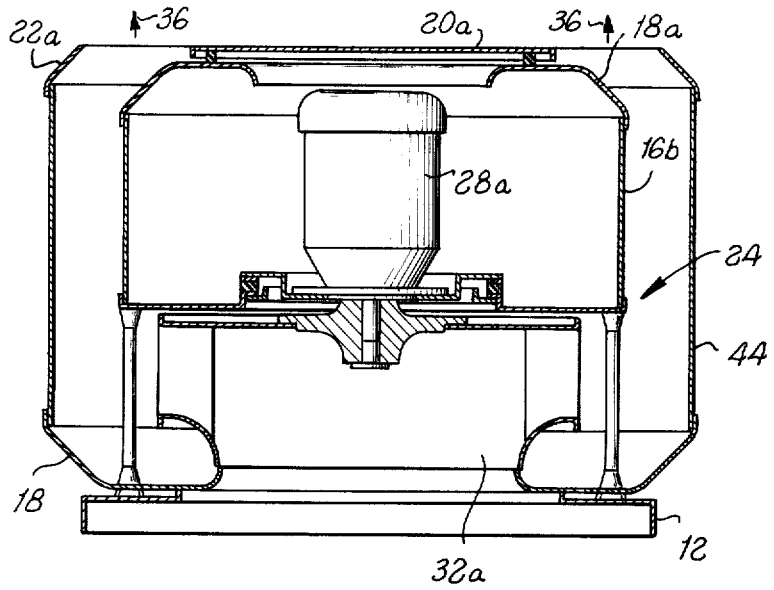
Figure 5:
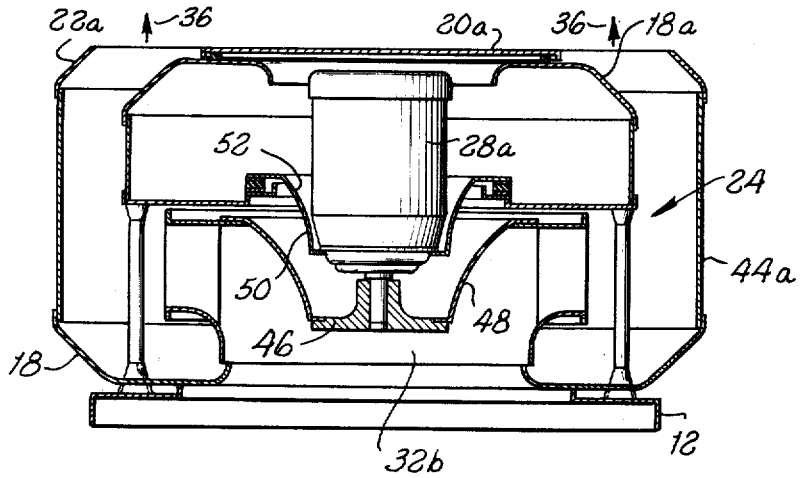

Some embodiments of the invention are described in greater detail below with reference to the accompanying drawings, in which:

FIG. 1 shows in axial section a roof ventilator for horizontal exhaust with an impeller wheel of radial design propelled by a motor with external rotor, FIG. 2 shows in axial section a roof ventilator for vertical exhaust, likewise with a radial impleller wheel propelled by a motor with external rotor, FIG. 3 shows, also in axial section, a roof ventilator similar to that of FIG. 1 but provided with a superimposed motor having an internal rotor, FIG. 4 shows an axial section of a roof ventilator similar to that of FIG. 2 but likewise with superimposed motor having an internal rotor, and FIG. 5 shows, also in axial section, a roof ventilator similar to that of FIG. 4 but with a motor of the internal-rotor type partly extending into the impeller wheel.

In the embodiment of FIG. 1 the ventilator is of the horizontal exhaust type and comprises a housing 10 which is supported on a base plate 12 provided with a centrally disposed inlet opening 14. The housing 10 comprises a middle cylindrical component 16 which is permeable to air and secured to the upper rim of a generally bowl-shaped bottom component 18 which has a central aperture 20 in alignment with the base plate opening 14. The upper rim of the middle component 16 is secured to a hood component 22 of inverted bowl-shape substantially identical with the bottom component 18 except that the hood component has no aperture corresponding to the aperture 20.

Within the housing 10 there is disposed a frame structure, generally indicated at 24, which is supported on the base plate 12, as shown, and in turn supports the stator 26 of an electric motor 28 of the external-rotor type, the rotor 30 of which has secured thereto an impeller wheel 32 with radial exhaust for directing air toward and through the air-permeable housing component 16, as indicated by the arrow-heads 34.

In FIG. 2 reference numerals identical with those in FIG. 1 are used to indicate corresponding elements. However, the ventilator in FIG. 2 is of the vertical exhaust type, as indicated by arrow-heads 36, and accordingly the middle cylindrical housing component **16*a* is impenetrable to air, while the hood component 22*a* is open to permit air discharged from the impeller wheel 32 to be deflected by the housing component 16*a* and exhausted through the opening in said hood component 22*a*.**

The assembly comprising the frame structure 24, the motor 28 and the impeller wheel 32 is covered at the top by a hood member 40 which is supported on the frame structure 24. Said hood member 40 is identical in shape with the hood component 22 in FIG. 1 but has a considerably smaller diameter. In fact, it is adapted to constitute a hood component of a housing similar to housing 10 but belonging to a series of roof ventilators of overall smaller dimensions that the ventilator of FIGS. 1 and 2.

The ventilator of FIG. 3 operates with horizontal exhaust and is similar to the ventilator shown in FIG. 1 except for the type and arrangement of the motor **28*a* which is of the internal-rotor type and disposed on top of the housing portion enclosing the impeller wheel 32***a*. The lastmentioned housing portion is identical with the housing 10 of FIG. 1, except that the hood component 22 of FIG. 1 has been replaced by an inverted bottom component 18*a* of the same diameter, i.e. belonging to the same size series of hood ventilators. The motor 28*a* extends through the central opening 20*a* in the component 18*a* and is surrounded by an air-impermeable cylindrical housing component 16*b* similar to the component 16*a* in FIG. 2 but of smaller size, i.e. belonging to a smaller size series of roof ventilators. To the upper rim of component 16*b* there is secured an inverted bottom component 18*a* of said smaller size series which has its central opening 20*a* closed by a plate 42.

The embodiment of FIG. 4 is similar to that of FIG. 3, with the exception of modifications due to the fact that the ventilator of FIG. 4 operates with vertical exhaust. Thus, the components 16 and 18*a* of FIG. 3 are omitted and the air-impermeable component 16*b* is supported directly on the frame structure 24. An air-impermeable cylindrical housing component 44 is secured to the upper rim of the bottom component 18 and in turn has a hood component 22*a* secured to its own upper rim, as shown.

The embodiment of FIG. 5 is similar to that of FIG. 4 except that certain modifications are made in order to decrease the overall height of the ventilator. Thus, the hub 46 of the impeller wheel 32*b* is disposed at the bottom of a trumpet-shaped member 48 which forms a part of the impeller wheel 32*b*, and the motor 28*a* extends down into a second trumpet-shaped member 50 secured to the hub disc 52 and belonging to a smaller size series of ventilators. Due to this arrangement the cylindrical components 16*c* and 44*a* have considerably lower height than the corresponding components in FIG. 4.

It is obvious, therefore, that ideal aerodynamic conditions are obtained in roof ventilators of low height in which the various components may be selected from series of components of uniform shapes and different sizes, thereby resulting in uniform external appearance and low manufacturing and assembling costs.

The invention is not limited to the specific embodiments shown and described but includes further modifications within the scope of the appended claims.

What I claim is:

1. A roof ventilator assembly system comprising:

a series of sizes of major components including base plates, bottom components, frames, middle sections, hoods, impeller wheels, and motors, each component in each size being useable with other components in that size series and at least one component in each size series being useable with components of at least one other size series;

the base plates being annular in shape and forming axial openings therein;

the bottom components being annular in shape and having axial openings therethrough corresponding to and overlying those of the base plates and having outer diameters;

the frames being mountable upon the base plates and bottom components;

the middle sections each comprising a cylindrical wall corresponding in diameter to one of the outer diameters of the bottom components to engage circumferentially an upper edge thereof, the middle sections comprising a first type wherein said cylindrical walls are permeable to a radial flow of air therethrough and a second type wherein said cylindrical walls are impermeable to radial air flow;

the hood components being annular in form and having outer diameters corresponding to those of middle sections and engaging said middle sections by upper edges thereof, the hood components comprising a first type wherein said annular form is a non-apertured disc and a second type wherein said annular form defines a central opening of substantial diameter, said first types of hood components and middle sections being useable together to form a ventilator with radial discharge, and said second types of hood components and middle sections being useable together to form a ventilator with axial discharge;

the motors being mountable on the frames in spaced axial relation to the bottom components and each carrying on a rotatable shaft thereof a corresponding impeller wheel; and the impeller wheels being rotatable with respect to the base plates and bottom components on said motor shafts and thereupon drawing air through said base plates to exhaust selectively in axial and radial directions.

2. A roof ventilator assembly system as defined in claim 1, wherein a hood of the first type and of a first size series selected from said system may axially cover the motor and frame in a roof ventilator of a larger size series and having a hood and middle section of the second types.

3. A roof ventilator assembly system as defined in claim 2, wherein an inverted bottom component of a first size series may serve as a hood on a middle section of the first type;

a middle section of the second type and a smaller size series may rest upon said inverted bottom component or hood and enclose radially said motor; and an inverted bottom component of said smaller size series may rest upon said middle section of the second type to enclose said motor axially.

4. A roof ventilator assembly system as defined in claim 1, wherein a ventilator may be constructed form said system having a middle section and hood of the second type in a first size series and also spaced therewithin a middle section of the second type and an inverted bottom section in a smaller second size series enclosing said motor.

* * * * *